United States Patent [19]

Triplett

[11] 4,442,943

[45] * Apr. 17, 1984

[54] FLOATING CRANE STABILIZER

[76] Inventor: James T. Triplett, P.O. Box 4, Chester, S.C. 29706

[ * ] Notice: The portion of the term of this patent subsequent to Nov. 16, 1999 has been disclaimed.

[21] Appl. No.: 322,954

[22] Filed: Nov. 19, 1981

[51] Int. Cl.[3] ..... B66L 23/52

[52] U.S. Cl. ..... 212/192; 212/190; 114/264

[58] Field of Search ..... 212/190, 191, 192, 193, 212/194; 114/264, 266, 293; 441/3, 4, 5; 414/138

[56] References Cited

U.S. PATENT DOCUMENTS 3,908,212 9/1975 van Heijst ..... 441/5

4,359,164 11/1982 Triplett ..... 212/192

*Primary Examiner*—Trygve M. Blix

*Assistant Examiner*—Thomas J. Brohan

*Attorney, Agent, or Firm*—Julian W. Dority

[57] ABSTRACT

The crane assembly includes a generally annular float assembly having a boom operatively carried by the float assembly for movement in a generally vertical plane. A mechanism is provided for rotating the float assembly and the boom together. A spacing member is provided having one end connected to a positioning structure and the other end terminating about the center of the annular float assembly below the surface of the water. A vertically extending spud extends between the float assembly and the other end of the spacing member.

5 Claims, 7 Drawing Figures

FLOATING CRANE STABILIZER

BACKGROUND OF THE INVENTION

Heretofore, floating cranes have been provided for building bridges, loading and unloading from docks, etc. which have typically included a rectangular barge structure upon which a crane is carried. Such rectangular barges typically range up to 200 ft. in length and 50 ft. in width, accommodating booms up to 300 ft. in length. When the crane boom carried on the barge swings laterally, the end of the barge loaded by the boom dips into the water placing side loads on the boom which, under certain severe conditions, can cause collapse of the boom. The resulting tilting of the barge to one side as the boom swings, makes accurate positioning of the boom difficult and makes the whole structure out of level. Waves from natural causes or from passing ships or even a small yacht can cause considerable lift and side loading of the boom structure.

Boom lengths have been limited on rectangular barges since the problems of maintaining the floating apparatus level and boom side loading increases with the length of the boom.

In my co-pending application entitled FLOATING CRANE APPARATUS, filed on Sept. 4, 1979, Ser. No. 06/072,347, there is disclosed a floating crane apparatus which includes a generally annular float assembly comprising individual pontoon members. Frame means interconnect a number of the pontoon members and are pivotally carried by a bridge so they can be pivoted inwardly when the pontoon members are disconnected for transportation.

A boom is operatively carried by the bridge and the float assembly for movement in a generally vertical plane. Propulsion means is carried by the float assembly for rotating the float assembly thereby moving the hoist boom means laterally in a unitary manner.

As disclosed in my co-pending application, a spud anchor is centrally located relative to the float assembly so that the entire floating crane can be rotated around the vertically extending spud anchor during operation.

One problem in utilizing a spud anchor is that its operation is limited by the depth of the water in which the crane is being operated.

Another problem of rotating the floating crane about a fixed spud is that if the crane is being utilized to unload a ship that is anchored, and the ship shifts due to current, it would tend to run over the floating crane tending to damage the crane and the spud that is anchored in the bottom.

SUMMARY OF THE INVENTION

It has been found that a floating crane structure affording all of the advantages of my co-pending application can be provided by fixing the position of the doughnut crane relative to a structure while permitting the crane to rotate freely about a vertical axis during its operation.

The crane assembly includes a generally annular float assembly having a boom operatively carried by the float assembly for movement in a generally vertical plane. Power operated means are provided for rotating the float assembly and the boom means. A spacing member is provided having one end connected to a positioning structure and the other end terminating about the center of the annular float assembly below the surface of the water. A vertically extending spud extends between the float assembly and the other end of the spacing member.

Means is provided for connecting the spud to the spacing member and the float assembly so that the floating crane assembly can be rotated relative to the positioning structure.

Accordingly, an important object of the present invention is to provide a floating crane structure in which side loading of the boom is substantially reduced during lateral movement of a load.

Another important object of the present invention is to provide a floating crane assembly that can be fixed relative to a moving object such as a ship by means of a positioning structure so that the distance between the floating crane structure and the ship remains the same at all times.

Another important object of the present invention is to provide a spacing member for a floating crane which minimizes the transfer of stresses between a floating crane and a positioning structure.

Still another important object of the present invention is to provide a device for attaching a floating crane to a structure for maintaining the space between the structure and the floating crane constant while permitting the crane to rotate relative to the structure and for permitting movement of the structure and the crane.

The construction designed to carry out the invention will be hereinafter described, together with other features thereof.

The invention will be more readily understood from a reading of the following specification and by reference to the accompanying drawings forming a part thereof, wherein an example of the invention is shown and wherein:

DESCRIPTION OF A PREFERRED EMBODIMENT

Figure 1:
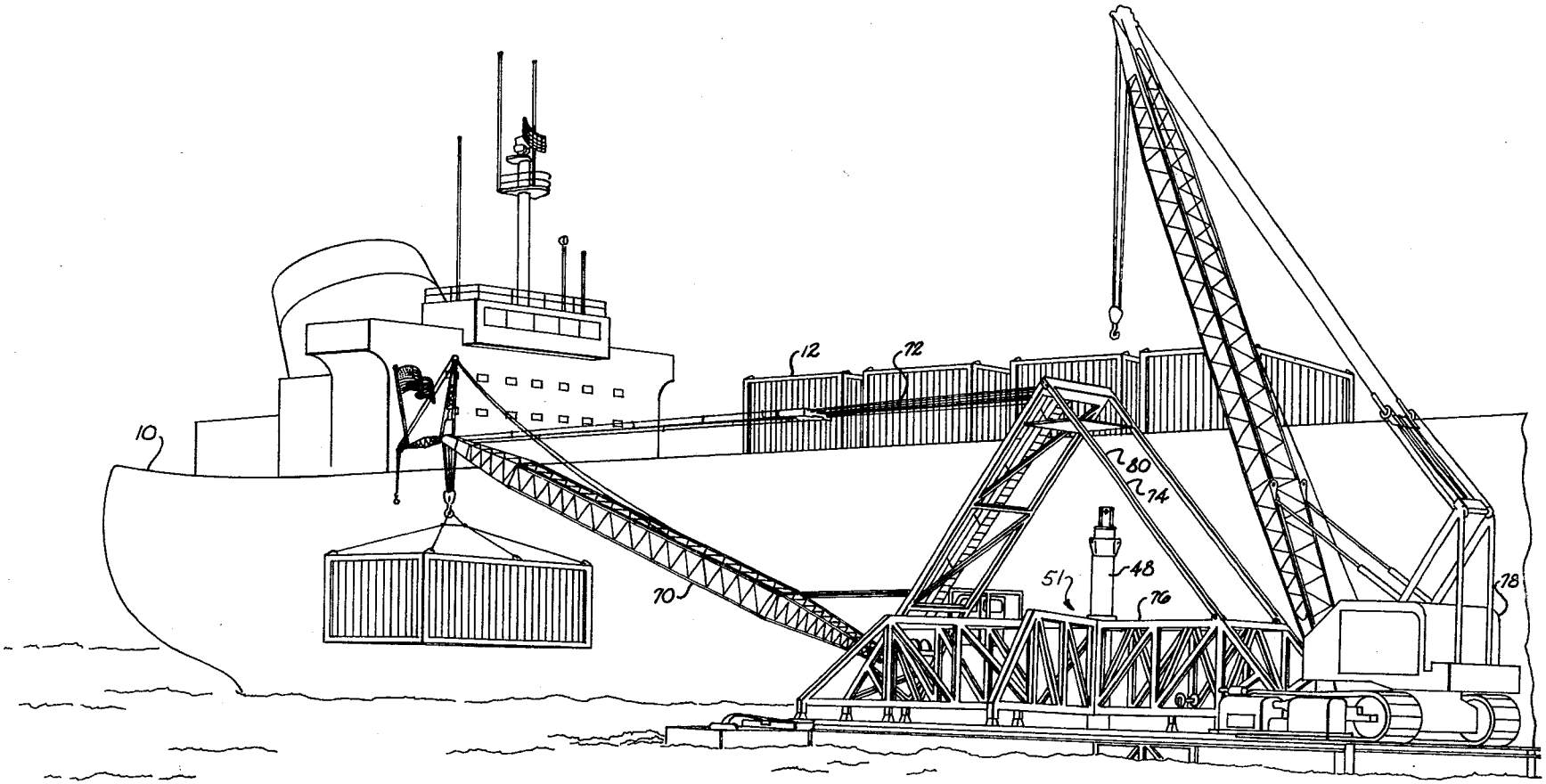
FIG. 1 is a perspective view illustrating a floating crane constructed in accordance with the present invention being used to unload a ship.

In FIG. 1, there is illustrated a ship 10 that is capable of transporting large containers. Often, a ship has to anchor in the harbour and wait its turn to approach a pier. Depending on how heavy the traffic is in the harbour, it sometimes requires several days before the ship is moved by tugs up to the loading dock. This, of course, affects the overall efficiency of the ship tremendously.

While it is possible to load or unload the ship while it is anchored, there is the problem of the ship shifting and if the crane being used is fixed relative to the bottom such as disclosed in my co-pending application, the ship will tend to run over the crane.

Figure 4:
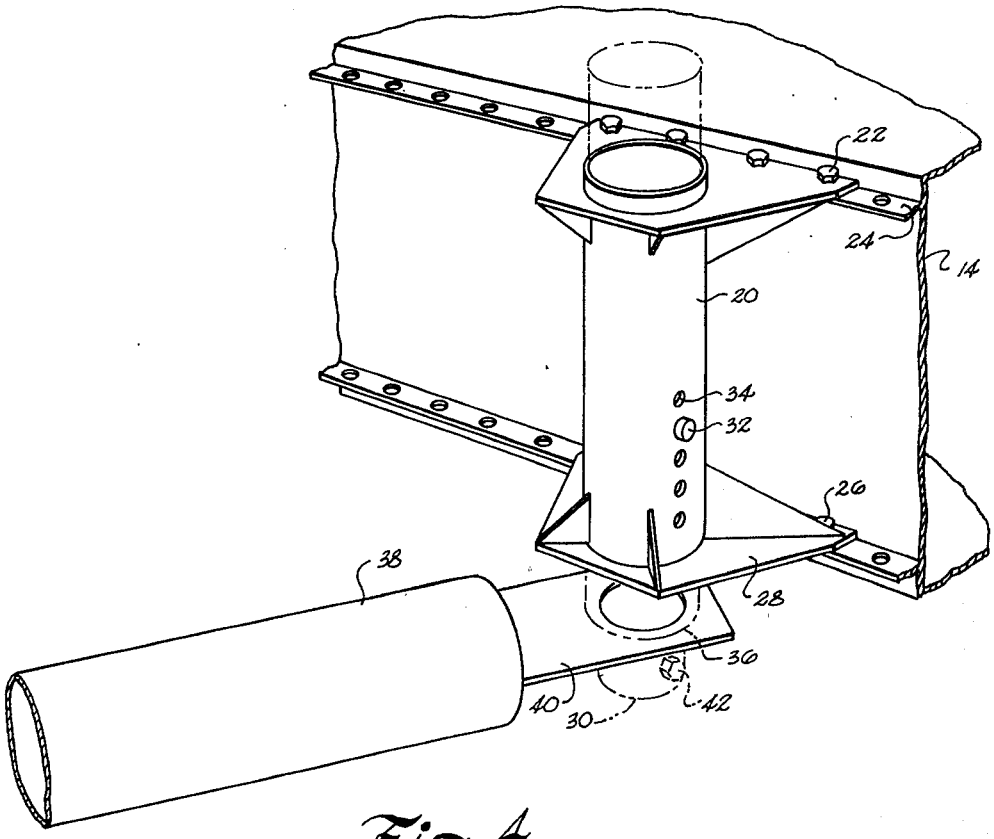
FIG. 4 is an enlarged perspective view illustrating the manner in which one end of a spacer arm is attached to a structure.

In order to avoid this problem, in one particular embodiment, a floating structure 14 is attached to the side 16 of the ship by any suitable means such as electromagnets 18. The float structure 14, in turn, has a pair of cylinders 20 pinned by means of pins 22 to a flange 24 provided on the side wall of the floating structure 14. Similar pins 26 connect the bottom of the cylinder 20 to the structure 14 by means of reinforced flanges 28. A spud 30 is inserted through the cylinder 20 and is secured therein by means of a pin 32 which fits into a hole provided in the side wall thereof for locking the spud within the cylinder 20. It is noted that there are a plurality of adjustable holes 34 into which the locking pin 32 can be inserted. The lower end of the spud 30 extends through an opening 36 provided in one end of a spacing means which, as shown in FIG. 4, is in the form of a spacing arm 38. The portion of the arm 38 through which the spud extends is a flattened plate 40 that is secured to the end of the cylindrical arm 38. A seal is provided in the end of the arm 38 and the specific gravity of the arm is slightly less than water so that the arm will tend to float. The specific gravity of the arm 38 can be controlled by many different ways such as by insertion of weighted material inside the cylinder 38 or by applying air. A pin 42 extends through the lower end of the spud for locking the flange portion 40 of the spacing arm 38 onto the spud.

The other end of the spud 38 also has a flattened portion 44 that has a hole 46 provided therein.

A main centrally located spud 48 extends through a collar 50 secured to the bridge 51 by means of support braces 54. The bridge and pivotable frame members 55 are described in more detail in my co-pending application, Ser. No. 06/072,347.

The lower end of the spud 48 has two reduced diameter sections 58 and 60. The reduced diameter section 60 extends through the hole 46 of the two diverging arms 38 and is secured therein by means of a bolt 62. When inserting the spud 48 through the holes 46 provided in the flanges 44 of the arms 38, the abutment formed by the juncture of the reduced diameter portion 60 and larger diameter portion 58 engages the portion of the flanges 44 surrounding the holes 46 causing the arms 54 to be pushed downwardly as the spud 48 is lowered to a predetermined level beneath the surface of the water. The arms should be held below the surface a sufficient depth so as to permit the floating crane to rotate over the arms during operation and also permit any type of propulsion unit to pass thereover.

During operation, the spud 48 which is on a vertical axis substantially centrally located within the annular ring of barges remains stationary and the entire barge structure, bridge and truss rotate around the spud as a result of the loose connection between the collar 50 and the spud 48.

A vertically adjustable shoulder (not shown) is secured adjacent the top of the spud 48 for limiting the downward movement of the spud 48 in order to control the depth that the arms are depressed below the surface of the water. Any suitable positioning means could be used.

Figure 2:
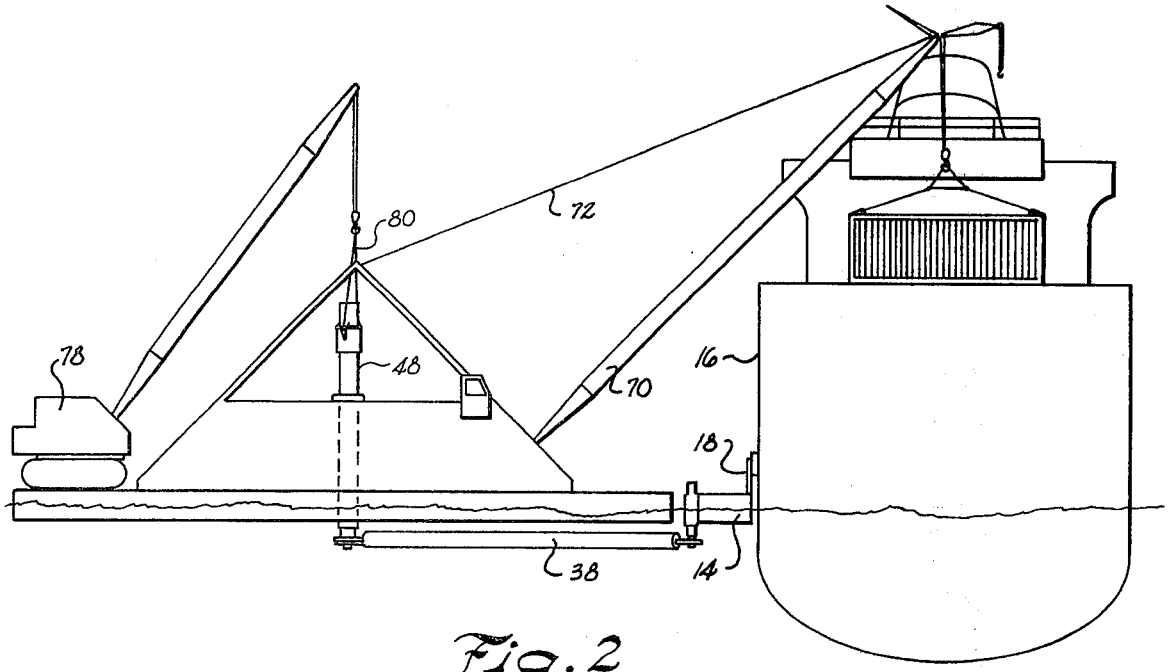
FIG. 2 is a side elevational view illustrating a floating crane being attached through spacer arms to a structure.
Figure 3:
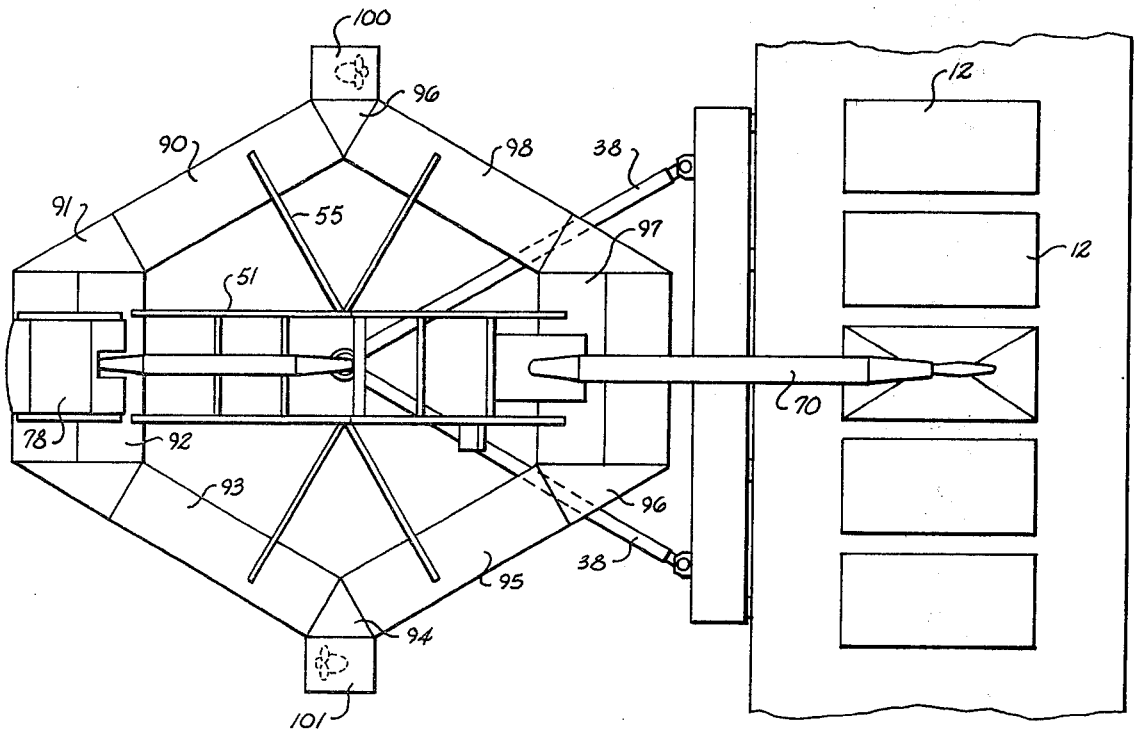
FIG. 3 is a plan view illustrating the manner in which the spacer arms are attached between the structure and the floating crane.

As shown in FIG. 1, 2 and 3, a boom 70 is pivotably secured adjacent one end of the generally annular barge assembly and is capable of being raised in a vertical direction by means of a conventionally powered boom hoist 72. The boom hoist is connected to the truss 74 extending above the bridge 51 and outriggers 55. A more detailed description of the bridge and outriggers is given in my co-pending application.

Figure 5:
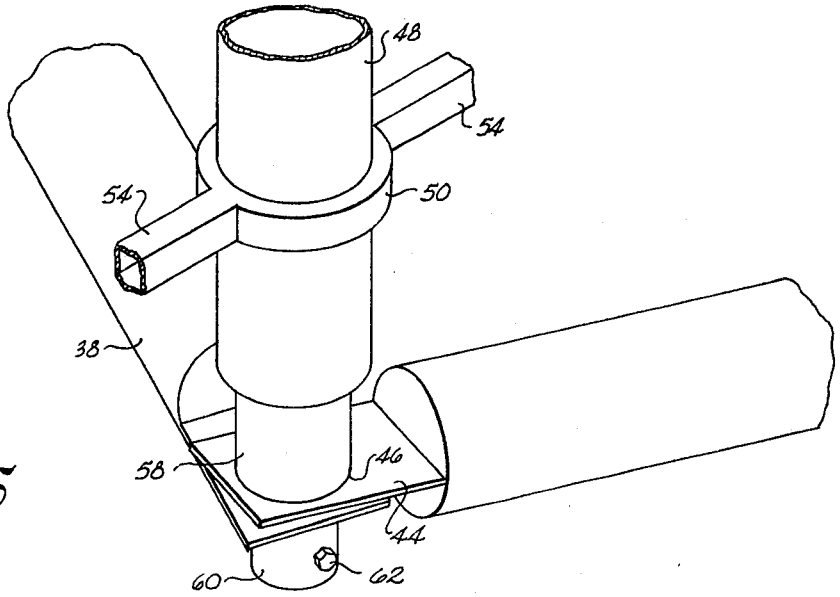
FIG. 5 is an enlarged plan view illustrating the manner in which the other end of the spacer arms is attached to a spud.

A conventional crawler crane 78 is positioned on the opposite end of the float assembly from the boom and its primary purpose is to raise and lower the central main spud 48 by means of cables 80. After the spud 48 has been lowered and locked into position such as shown in FIG. 5, the cable can be removed, and the crawler crane can either be removed from the barge assembly or remain in position.

The pontoons 90, 91, 92, 93, 94, 95, 96, 97, 98, and 99 are pinned together in annular configuration so that they can be disassembled to fit together for transporting such as disclosed in more detail in my co-pending application.

Propulsion units 100 and 101 are pinned to the pontoons 94 and 96. In one particular embodiment, the propulsion units are hydraulically operated propellor motors. By controlling the direction of rotation of the propulsion units 100 and 101, the entire pontoon system with the cranes mounted thereon can be rotated about the central spud 48 during the loading and unloading of loads. As a result of the spacer member, which includes the pair of arms 38 being connected to the barge structure 14, a minimum of stresses are transmitted from the annular floating crane to the rectangular barge 14.

Sufficient play should be provided between the collar 50 and the main spud 48 to allow pivoting of the spud within the collar 50 as loads are lifted by the main boom 70. When a load is lifted by the main boom 70, that end of the barge will tend to be lowered into the water causing the other end to be raised slightly. This tilting condition remains constant as the boom is rotated annularly with the rotation of the complete doughnut shaped barge assembly. Therefore, adverse side loading of the boom is avoided.

While the structure 14 shown in FIGS. 2 and 3 for attaching the floatation crane to a ship is in the form of a barge, it is to be understood that this structure could be a permanent dock, a work barge or could be part of the ship itself. The important thing is that the crane is maintained by the spacing members 38 at a fixed distance from the structure regardless of whether the structure 14 is stationary or moves.

It is also understood that while the spacing members 38 are shown in the form of tubular members, other suitable type of spacing members could be utilized such as a submersible barge having a spud provided thereon which extends upward through the collar 50.

Figure 6:
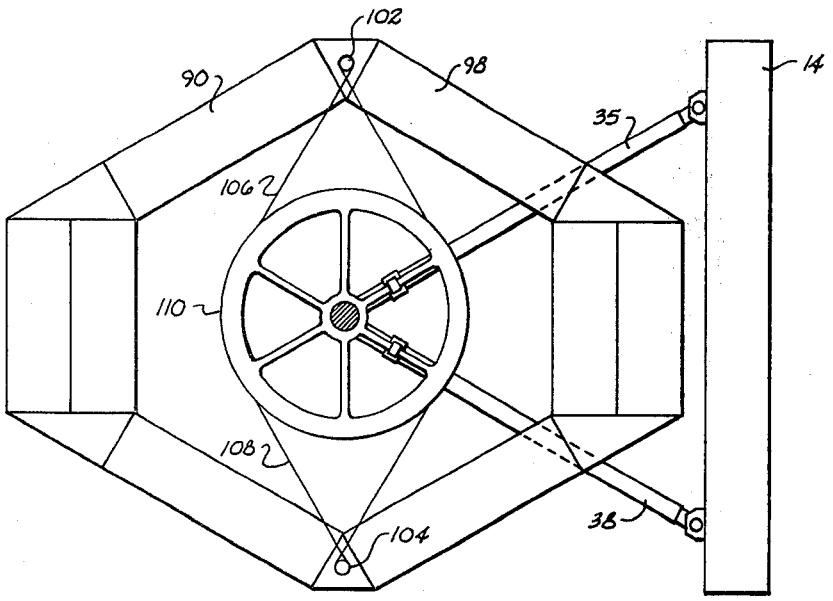
FIG. 6 is a plan view illustrating a mechanism for rotating the floating crane.
Figure 7:
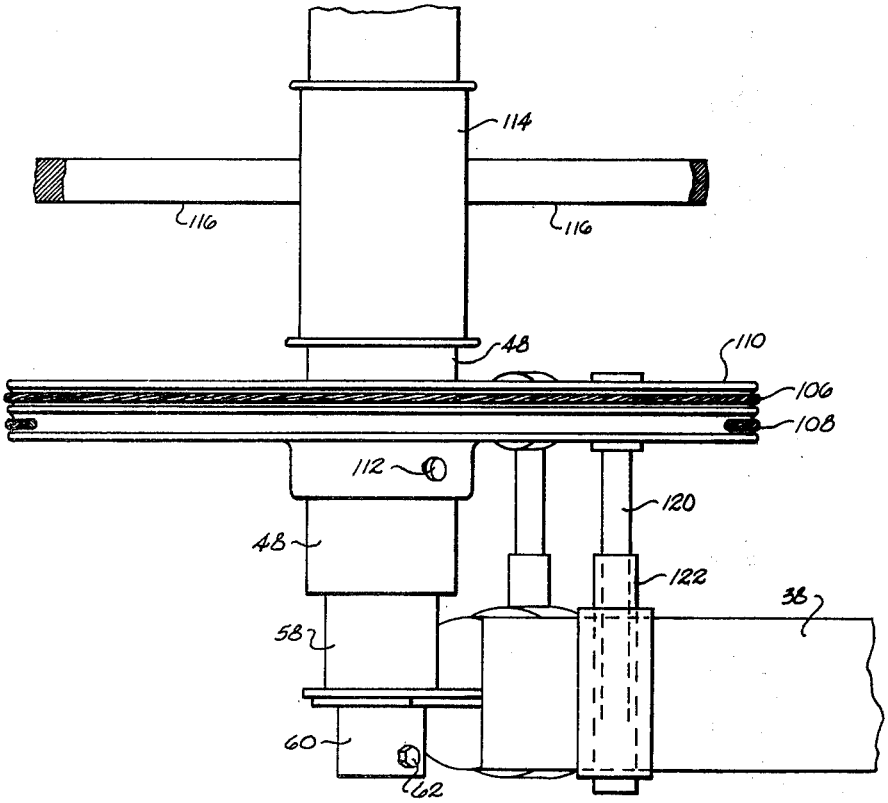
FIG. 7 is an enlarged elevational view illustrating the manner in which the spacer arms are attached to a spud and a pulley wheel of FIG. 6.

In FIGS. 6 and 7, there is disclosed a modified form of the invention wherein the power operated means for rotating the floating crane includes a pair of power driven capstans 102 and 104. Cables 106 and 108 extend between a respective capstan and a groove provided in an enlarged pulley wheel 110.

The pulley wheel 110 is, in turn, fixed by means of a bolt 112 to the centrally located spud 48. The spud 48 extends through a sleeve 114 that is, in turn, supported by truss 116 on the truss members carried by the floatation pontoons. The pulley wheel 110 is attached to the arms 38 by means of a vertically extending rod 120 which slides within a tubular sleeve 122 carried by the arms 38. As a result, when the capstan are driven, the entire pontoon assembly is rotated relative to the pulley wheel 110 and the arms 38 for shifting the boom.

The reason that a rod 120 and sleeve 122 are used for connecting the pulley wheel to the spacer arms 38 is to enable the barge to tilt under load conditions. Similar play is required between the main sleeve 114 for permitting tilting relative to the spud 48.

In operation, in order to secure the arm to the central spud 48, the inner ends of the arms 38 are depressed down below the surface of the water and the floating crane is driven thereover. The arms are then positioned directly beneath the centrally located spud and the reduced diameter end 60 of the spud is inserted through the holes 46. As the spud is lowered, it depresses the arms 38 below the water level to a predetermined depth.

The other ends of the arms are then secured to the spud wells 20 by means of the spuds 30.

As a result of the above described connection, the floating crane is always maintained at the same distance from the structure 14 and the ship to which the structure 14 is attached. If the ship moves, then the floating crane and structure move with it while stresses that may occur in the floating crane are isolated from the structure 14.

While a preferred embodiment of the invention has been described using specific terms, such description is for illustrative purposes only, and it is to be understood that changes and varitions may be made without departing from the spirit or scope of the following claims.

What is claimed is:

1. A device for attaching a floating crane to a structure, said floating crane including a generally annular float assembly, a boom carried on said assembly, and a power-operated means for rotating said crane about a vertical axis when moving a load supported on said boom said device comprising:

a spacing member having one end attached to said structure;

a vertically extending spud extending between said floating crane and the other end of said spacing member on said vertical axis.

means for connecting said spud to said spacing member and said floating crane so that said floating crane can be rotated relative to said structure on said vertical axis.

2. The device as set forth in claim 1 further comprising:

said spacing member including a pair of arms, said means for connecting said spud to said spacing member including:

(i) holes provided in the ends of said arms positioned below said spud, and (ii) a lower end of said spud extending through said holes in said arms for holding said floating crane a predetermined distance from said structure.

3. The device as set forth in claim 1 further comprising:

said arms having a specific gravity less than water so that said arms float adjacent the surface of the water, flange means provided on said spud for pressing said arms below the surface of the water when said spud is inserted through said holes in said arms allowing said floating crane to pass thereover as said floating crane is rotated.

4. A floating crane assembly comprising:

a generally annular float assembly;

boom means operatively carried by said float assembly for movement in a generally vertical plane;

power operated means for rotating said float assembly and said boom means;

a positioning structure;

a spacing member having one end connected to said positioning structure and the other end terminating about the center of said annular float assembly below the surface of the water;

a vertically extending spud extending between said float assembly and the other end of said spacing member;

means connecting said spud to said spacing member and said float assembly so that said floating crane assembly can be rotated relative to said positioning structure.

5. The floating crane assembly as set forth in claim 4 further comprising:

said power operating means for rotating said float assembly including:

(i) a pair of power driven capstans carried by said float assembly;

(ii) an enlarged pulley wheel carried by said vertically extending spud, and (iii) cable means extending around said pulley wheel and said capstans for rotating said floating crane assembly upon said capstans being rotated.

* * * * *